US010253579B2

(12) United States Patent
Amaudric Du Chaffaut

(10) Patent No.: US 10,253,579 B2
(45) Date of Patent: Apr. 9, 2019

(54) MOTION COMPENSATION SYSTEM FOR A LOAD HANGING FROM A MOBILE UNIT WITH A MAIN CYLINDER AND A SECONDARY CYLINDER

(71) Applicant: IFP Energies nouvelles, Rueil-Malmaison (FR)

(72) Inventor: Benoit Amaudric Du Chaffaut, Ecully (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

(21) Appl. No.: 15/847,578

(22) Filed: Dec. 19, 2017

(65) Prior Publication Data

US 2018/0171727 A1 Jun. 21, 2018

(30) Foreign Application Priority Data

Dec. 19, 2016 (FR) ..... 16 62.761

(51) Int. Cl.

| | |
|---|---|
| ***B66C 13/02*** | (2006.01) |
| ***B66C 23/52*** | (2006.01) |
| ***E21B 15/02*** | (2006.01) |
| ***E21B 19/00*** | (2006.01) |

(52) U.S. Cl.

CPC ..... *E21B 19/006* (2013.01); *B66C 13/02* (2013.01); *B66C 23/52* (2013.01); *E21B 15/02* (2013.01)

(58) Field of Classification Search

CPC ..... E21B 19/006; E21B 15/02; B63B 27/30; B66D 1/52; B66D 1/48; B66D 2700/0108

See application file for complete search history.

(56) References Cited

U.S. PATENT DOCUMENTS

| | | | | |
|---|---|---|---|---|
| 3,549,129 | A * | 12/1970 | Graham | B63B 21/56 114/245 |
| 3,788,074 | A * | 1/1974 | Castela | E21B 19/09 175/5 |
| 3,791,628 | A | 2/1974 | Burns et al. | |
| 3,881,695 | A * | 5/1975 | Joubert | E21B 19/09 166/355 |
| 9,371,705 | B2 * | 6/2016 | Birkeland | E21B 19/09 |
| 2009/0232625 | A1 * | 9/2009 | Almeda, Jr. | B66C 23/52 414/139.6 |

(Continued)

FOREIGN PATENT DOCUMENTS

| | | |
|---|---|---|
| FR | 3025787 A1 | 3/2016 |
| FR | 3027298 A1 | 4/2016 |

(Continued)

OTHER PUBLICATIONS

Preliminary Search Report (2 pages).

*Primary Examiner* — James G Sayre

(74) *Attorney, Agent, or Firm* — Fitch, Even, Tabin & Flannery, LLP

(57) ABSTRACT

The present invention relates to a motion compensation system for a load hanging from a mobile unit (1). The compensation system comprises two blocks (3 and 4), an articulated arm (2), a cable (5), at least one main cylinder (6) and at least one secondary cylinder (7). The secondary cylinder (7) is mounted to pivot (rotation about a substantially horizontal axis) on mobile unit (1) and on a joint of articulated arm (2).

26 Claims, 4 Drawing Sheets

(56) References Cited

U.S. PATENT DOCUMENTS

| | | | | |
|---|---|---|---|---|
| 2015/0008382 | A1* | 1/2015 | Bergan | B63B 39/00<br>254/398 |
| 2017/0254384 | A1 | 9/2017 | Amaudric du Chaffaut | |
| 2017/0321498 | A1 | 11/2017 | Mabile | |

FOREIGN PATENT DOCUMENTS

| | | | | |
|---|---|---|---|---|
| KR | 20120035432 | A | 4/2012 | |
| NL | 7310417 | A | 1/1974 | |
| WO | 2004/001193 | A2 | 12/2003 | |
| WO | WO-2016062437 | A1 * | 4/2016 | B66C 13/02 |

* cited by examiner

MOTION COMPENSATION SYSTEM FOR A LOAD HANGING FROM A MOBILE UNIT WITH A MAIN CYLINDER AND A SECONDARY CYLINDER

CROSS REFERENCE TO RELATED APPLICATION

Reference is made to French Patent Application No. 16/62.761, filed Dec. 19, 2016, which application is incorporated herein by reference in its entirety.

BACKGROUND OF THE INVENTION

Field of the Invention

The present invention relates to the field of motion compensation for a mobile element hanging from a mobile unit. More particularly, the invention relates to heave motion compensation of an offshore floating unit supporting either a drill string ending in a drill bit (drillstem), or a riser pipe rigidly connected to an equipment attached to the sea bottom. Such a floating unit also requires vertical motion heave compensation when laying and especially when assembling various equipments on the sea bed, such as for example a subsea wellhead for example.

Description of the Prior Art

Conventionally, load support systems are made using a rope winch and a set of fixed and mobile pulleys. By means of these load support systems, the load is likely to be handled more or less regularly, for example when progressively increased (successive additions of pipes to a drill string), then partly laid on the bottom (hole), and finally lifted and laid back as often as necessary as the hole is being deepened.

However, at sea, the wave motion causes, among other things, heave which is an oscillating motion of vertical translation of the floating units. When the latter support an equipment in contact with the bottom, such as a drill string, the heave needs to be compensated for so that the contact force of the bit on the hole bottom is maintained, within acceptable limits.

To compensate for such motions, there are three major families of devices:

- Devices that are set in the drill string: The part of the string located above the device still undergoes the heave motion with the floating unit, whereas the part of the string located below the device remains practically motionless relative to the sea bottom;
- Devices that are interposed between the string and the drill rig lifting system; and
- Devices that are integrated in the lifting system.

For this third family, a compensation system comprises at least one main cylinder whose one end is fixedly attached (without relative motion) to the upper end of the load (crown block) and the other end is fixedly attached (without relative motion) to the mobile unit. Each main cylinder follows the heave motion and its action is therefore exerted vertically or in a direction very close to the vertical. Furthermore, the compensation system comprises at least one articulated arm connecting the mobile unit to the crown block. Each articulated arm is made up of rigid elements articulated relative to one another which in this case is by pivot links between the rigid elements. For the same reason as for the main cylinders, these arms are mobile in substantially vertical planes and the axes of their joints are horizontal.

The performance of such a system, measurable by the variation of the contact force of the bit on the hole bottom (weight on bit), essentially depends on the volume of the compressed gas accumulators. The variation of the weight on bit will be all the smaller as the volume of the accumulators is larger, which can be rapidly penalizing on a floating support in terms of weight, size and associated costs.

Document FR-2,575,452, which corresponds to U.S. Pat. No. 5,520,369, describes such a system comprising two blocks, at least one compensation cylinder connected to accumulators, a cable and two articulated arms including pulleys and rods that allow to compensation for a motion of an element hanging from a mobile unit. This system allows reduction of the volume of the accumulators through a suitable geometry of the articulated arms and to partly reduce the error. However, for this design, the volume of the accumulators remains large (approximately 16 $m^3$ for a conventional design), and compensation errors remain significant and the force on the load does not remain very constant.

Patent application WO-2014/001,193 describes an improvement of the system described in document FR-2, 575,452. The improvement uses, in addition to the vertical main cylinders, secondary cylinders connecting the floating unit to some rods of the articulated arms. However, with this design, the secondary cylinders apply a bending stress onto these rods, which is in addition to the traction or compression undergone, that requires oversizing of these rods. Furthermore, this patent application specifies that the main cylinders and the secondary cylinders are connected to the same compressed gas reserve, which makes the system inefficient and not easily adjustable.

SUMMARY OF THE INVENTION

In order to overcome these drawbacks, the present invention relates to a motion compensation system for a load hanging from a mobile unit. The compensation system comprises two blocks, at least one articulated arm, a cable, at least one main cylinder and at least one secondary cylinder. The secondary cylinder is mounted to pivot (rotation about a substantially horizontal axis) on the mobile unit and rotatably on the joint of the articulated arm. Thus, the secondary cylinder allows increasing the motion compensation precision, to make the system adjustable, and its action on the articulated arm joint prevents bending stresses acting on the rods of the articulated arm, and therefore permits making the rods lighter.

The invention relates to a motion compensation system for a load hanging from a mobile unit, comprising a crown block, a travelling block for fastening the load, at least one articulated arm for connecting the crown block to the mobile unit, each articulated arm comprising at least one pulley, a cable running through the pulleys of each articulated arm and through the first and second blocks, and at least a first main cylinder fastened to the mobile unit and to the crown block. The compensation system comprises at least a secondary cylinder rotationally mounted on the mobile unit and rotatably on the joint of the articulated arm.

According to an embodiment of the invention, the main cylinder is a hydropneumatic cylinder connected to an oleopneumatic accumulator.

According to an implementation of the invention, the secondary cylinder is a pneumatic cylinder connected to a pneumatic accumulator.

Advantageously, the articulated arm comprises at least two connecting rods articulated relative to one another and a pulley arranged at the joint of the rods on which the secondary cylinder is rotationally mounted.

Advantageously, each end of the rods comprises a pulley for passage of the cable.

According to an implementation option, the compensation system comprises at least two articulated arms which are arranged symmetrically relative to the axis formed by the first and second blocks.

According to an embodiment, the compensation system comprises at least two secondary cylinders arranged symmetrically relative to the axis of the main cylinder, so that the components of the actions of the secondary cylinders which are orthogonal to the direction of displacement of the crown block cancel each other out for any position of the crown block.

According to an embodiment, the motion compensation system comprises two main cylinders.

According to a variant embodiment, the compensation system comprises two secondary cylinders for each articulated arm.

Furthermore, the invention relates to a use of a motion compensation system according to one of the above characteristics, for heave compensation for at least one of a subsea drill bit support and load laying.

BRIEF DESCRIPTION OF THE DRAWINGS

Other features and advantages of the system according to the invention will be clear from reading the description hereafter of embodiments given by way of non-limitative example, with reference to the accompanying figures wherein.

DETAILED DESCRIPTION OF THE INVENTION

Figure 1:
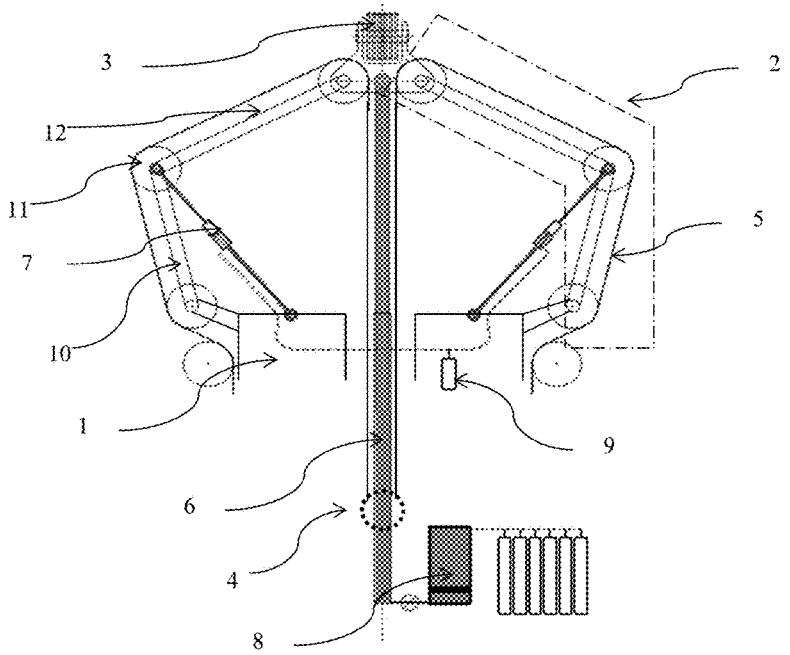
FIG. 1 illustrates a motion compensation system according to an embodiment of the invention.

The present invention relates to a motion compensation system (heave compensator) for an element (also referred to as load) attached to (or hanging from) a mobile unit (for example a ship, a floating platform, etc.). The load is likely to be handled more or less regularly, for example progressively increased (for successive additions of pipes to a drill string), then partly laid on the bottom (hole), and finally lifted and laid back as often as necessary as the hole is being deepened. These maneuvers are most often performed using a rope winch and a set of fixed and mobile pulleys (block and tackle) allowing reduction of the effort required from the winch, at the cost of a greater cable length. The block and tackle has a first block, referred to as crown block, and of a second block, referred to as travelling block. It is noted that a block is a mechanical device allowing a load to be lifted by several cable strands.

The compensation system comprises:

at least a main cylinder having one end fixedly attached (without relative motion) to the upper end of the load (crown block) and another end fixedly attached (without relative motion) to the mobile unit. Each main cylinder follows the heave motion and its action is therefore exerted vertically or in a direction very close to the vertical;

at least one articulated arm, preferably two, four or six arms, arranged symmetrically with the at least one articulated arm connecting the mobile unit to the crown block. Each articulated arm is made up of rigid elements articulated relative to one another, in this case by pivot links between the rigid elements. For the same reason as for the main cylinders, these arms are mobile in substantially vertical planes and the axes of their joints are horizontal.

The articulated arms allow the length of the cable to be kept substantially constant upon motion of the first block relative to the mobile unit.

The increase in the number of articulated arms notably allows the maximum load allowable by the compensation system to be increased.

The articulated arm(s) described above are equipped with at least one pulley arranged at least one of one end and a joint of the arms to guide the operation cable strands coming out of the crown block in parallel with the rigid elements making up the arms. The goal of such a path is to keep the length of the operation cable strands constant between the crown block and their ties to the mobile unit, winch and deadline anchor (as described in patent application FR-2, 575,452 (U.S. Pat. No. 5,520,369)), so as to make the tension of the cable independent of the relative positions of the crown block and of the mobile unit.

According to an alternative, the articulated arm can comprise three articulated connecting rods.

According to the invention, the motion compensation system further comprises at least one secondary cylinder. The secondary cylinder connects the mobile unit to a joint of the articulated arm. The secondary cylinder is mounted to pivot (rotationally mounted) on the mobile unit and is mounted rotatably on the articulated arm joint. In other words, the secondary cylinder can pivot with respect to the mobile unit about a substantially horizontal axis, and the secondary cylinder can pivot around the hinge axis of the articulated arm about a substantially horizontal axis. By use of the secondary cylinder, the rigid element of the articulated arm integral with the head of the main cylinder exerts an additional force on the main cylinder head. The combined action of the main cylinder and of the secondary cylinder allows providing compensation for the motion of the mobile unit (heave). The principle of this architecture is to exert an additional force on the upper end of the load (crown block) provided by the secondary cylinder. The secondary cylinder allows the motion compensation to be optimized in relation to the use of a main cylinder alone, and it allows downsizing the main cylinder and its energy source. Furthermore, the link of the secondary cylinder with the articulated arm joint allows bending stresses to be avoided in the connecting rods of the articulated arm.

The motion of the mobile unit (heave for example) is compensated for by the movement of the crown block with respect to the mobile unit. Thus, the load hanging from this crown block is stationary with respect to a fixed reference point (the sea bottom for example). The motion of the crown block relative to the mobile unit is controlled by the cylinders.

The crown block can be mounted on a supporting element (a frame for example) and the main cylinder can then be arranged between the mobile unit and the frame.

The articulated arms allow the length of the cable to be maintained substantially constant upon motion of the crown block relative to the mobile unit.

According to an embodiment of the invention in which the compensation system comprises an even number of articulated arms, the compensation system can comprise at least two secondary cylinders arranged symmetrically relative to the axis of the main cylinder, so that the components of the actions of the secondary cylinders which are orthogonal (i.e. substantially horizontal) to the direction of displacement of the first block cancel each other out for any position of the first block. Thus, the resultant of the actions of the cylinders on the first block is substantially vertical.

Preferably, each articulated arm can comprise two connecting rods and a pulley. A first end of a first rod can be articulated on the mobile unit. Moreover, a second end of a first rod can be articulated relative to a first end of the second rod. Furthermore, a second end of the second rod can be articulated relative to the first crown or relative to the frame supporting the first crown. Moreover, a pulley can be provided at the joint between the two rods.

According to an alternative, the articulated arm can comprise three articulated connecting rods.

According to a preferred embodiment of the invention, each articulated arm having two connecting rods is associated with a secondary tie-rod cylinder, in the vertical plane defined by the two rods, between the joint of the rods and the mobile unit. The force exerted by the cylinder produces compression for the rod attached to the crown block. The vertical component of this compression adds to or deducts from the vertical force of the main cylinder(s), depending on the inclination of the connecting rod. The articulated arms which are arranged symmetrically with respect to the vertical axis of motion of the load, cancels the horizontal components of the compressions of the connecting rods attached to the crown block. When these rods are horizontal themselves, the effect of the secondary cylinders is zero with the load being then carried by the main cylinders alone. The dimensions and positions of the articulated arms, as well as the characteristics of the main and secondary cylinders, are so selected that the resultant of the forces exerted on the crown block by the main cylinders on the one hand, and by the connecting rods attached to the crown block on the other hand, remain as close as possible to the force exerted by the main cylinders when the rods attached to the crown block are horizontal. Ideally, this resultant is constant throughout the stroke of the main cylinders, and the compensation is then referred to as "isodyne" which is at constant force.

According to an embodiment of the invention, the nominal load of the compensation system may be considered to correspond to the force exerted by the main cylinders at mid-stroke. The extreme deviations, positive and negative, of the force exerted by the main cylinders in relation to the nominal load correspond to the start and to the end of the stroke of these cylinders. Thus, the articulated arms and the associated secondary cylinders can be dimensioned to best compensate for these deviations. For example, if the nominal load is 450 tons, and if the main cylinders exert a 550-ton force at the stroke start and a 350-ton force at the stroke end, it can be assumed that the force at mid-stroke is close to 450 tons. The vertical forces required of the articulated arm-secondary cylinder assemblies will therefore range between 0 and 100 tons, upwards or downwards depending on the position, above or below, at mid-stroke, where the connecting rods attached to the crown block are substantially horizontal and the compensating force thus is zero.

According to a configuration of the invention, the compensation system can comprise two secondary cylinders for each articulated arm. In this case, the two secondary cylinders can be arranged parallel between the mobile unit and the articulated arm joint. Advantageously, the two secondary cylinders are rotationally mounted on the joint on either side of the pulley and the rods. This configuration allows the forces to be balanced on the articulation axis. Furthermore, this configuration allows reduced-size secondary cylinders to be used.

Advantageously, the articulated arm-auxiliary cylinder assemblies can be arranged symmetrically with respect to the vertical axis of the load, and the horizontal components of the additional forces balance and cancel each other out. Thus, the resultant of the vertical components adds up to or deducts from the force of the main cylinders, depending on the inclination of the connecting rods.

According to an embodiment of the invention, the main cylinder can be a hydropneumatic cylinder connected to an oleopneumatic accumulator. The term accumulator designates a reserve of compressed gas, air for example, in connection with an intermediate cylinder of oleopneumatic type that separates the gas of the reserve gas from the oil of the hydraulic cylinder. The compressed gas reserve can come in the form of gas bottles. Thus, the main cylinders can be connected to a compressed gas reserve providing the required elasticity. An incompressible liquid is arranged between the cylinders and the gas reserve to provide system safety through rapid closing of a valve which prevents a gas expansion which is unacceptably fast in a case of a sudden change in load. The embodiment of this oleopneumatic damping system can be identical to that described in document French patent 2,575,452 which corresponds to U.S. Pat. No. 5,520,369 with a reduced-size oleopneumatic accumulator. When at least two main oleopneumatic cylinders are used, it is possible to share the accumulator to balance the pressures and therefore the forces in the hydraulic cylinders.

According to an embodiment of the invention, the secondary cylinder can be a pneumatic cylinder connected to a pneumatic accumulator, which can be gas bottles. The pneumatic accumulator is distinct from the oleopneumatic accumulator provided for the main cylinder. The compensation system then comprises two independent accumulators. Thus, each type of cylinder (main or secondary) has its own energy source, which allows the compensation precision to be improved.

Thus, the possibility of limiting significant differences regarding the forces exerted by the main cylinders allows substantially reducing the size of the oleopneumatic accumulators associated with these main cylinders.

According to an implementation option, the volume of the pneumatic accumulator of the secondary cylinders is much smaller than the volume of the oleopneumatic accumulator of the main cylinders. For example, for the aforementioned load value of 450 tons associated with a 7.62-m (25 ft) stroke of the main cylinders, the best compensation (±2.54 tons, i.e. 0.54% of the load) is reached with a 6-$m^3$ volume for the main accumulator and a 0.4-$m^3$ volume for the secondary accumulator, with maximum pressures of 210 and 167 bar respectively.

Alternatively, the secondary cylinders can be driven, hydraulic, pneumatic or electric cylinders. It is thus possible to have a partly active compensation system.

According to a feature of the invention, the compensation system can comprise two main cylinders arranged symmetrically between the mobile unit and the crown block (or the frame supporting the crown block).

FIG. 1 schematically illustrates by way of non-limitative example a motion compensator according to an embodiment of the invention. In this figure, the load is not shown. A load hangs from a travelling block 4, connected by a cable 5 to a crown block 3. Crown block 3 is mounted on a frame that is connected to mobile unit 1 by two articulated arms 2. Each articulated arm comprises a lower connecting rod 10 articulated rotate about a substantially horizontal axis relative to mobile unit 1 and an upper rod 12 articulated rotate about a horizontal axis on the one hand relative to crown block 3 and, on the other hand, relative to lower rod 10. The joint between upper rod 12 and lower rod 10 further comprises a pulley 11. Pulleys are also provided at the ends of rods 10 and 12. Cable 5 runs through all the pulleys of the articulated arms and through the two blocks. The compensation system comprises a main cylinder 6 and two secondary cylinders 7. Main cylinder 6 is a hydraulic cylinder whose one end is attached to mobile unit 1 and whose other end is attached to the frame on which crown block 3 is mounted. Main cylinder 6 is powered by an oleopneumatic accumulator 8. The compensation system further comprises two secondary cylinders distributed symmetrically on either side of the load. Secondary cylinders 7 are arranged between mobile unit 1 and a joint of articulated arm 2, at pulley 11. The two secondary cylinders 7 are pneumatic cylinders powered by a pneumatic accumulator 9.

FIGS. 2*a* to 2*d* schematically illustrate by way of non-limitative example the operation of the compensation system according to the invention for four different positions. In these figures, the cylinders are schematically represented by springs. Furthermore, in the figures, the mobile unit, the blocks, the pulleys and the cable are not shown. The figures illustrate two articulated arms with a lower connecting rod 10 and an upper rod 12 that connect the mobile unit to the first block, as well as main cylinder 6 and two secondary cylinders 7 connecting the mobile unit to the articulated arm joint. In the upper part of the figure, the forces exerted on the crown block are shown. Fp corresponds to the force exerted by the main cylinder on the first block, Fs represents the forces exerted by the secondary cylinders on the crown block through the agency of the connecting rods 10 and 12, and P is the resultant of these three forces. It can be noted that the selected configuration allows the resultant of the forces on the crown block to remain vertical and of identical value for any position of the first block, which enables load motion compensation.

Figures 2A, 2B, 2C, 2D:
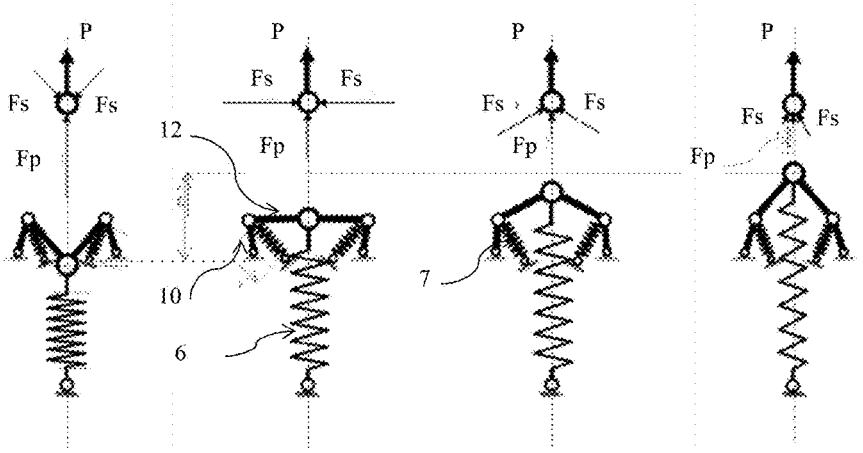
FIGS. 2*a* to 2*d* schematically illustrate positions of a motion compensator according to an embodiment of the invention.

FIG. 2*a* illustrates the lowest position of the first block. In this position, main cylinder 6 is compressed and exerts a maximum force Fp on the first block. Furthermore, in this position, upper connecting rod 12 is inclined downwardly and therefore the forces Fs exerted by secondary cylinders 7 on the crown block are directed downwards. The vertical component of forces Fs of the secondary blocks therefore deducts from force Fp of the main cylinder.

FIG. 2*b* illustrates an intermediate position of the first block where upper connecting rods 12 are substantially horizontal, i.e. substantially orthogonal to the path of the first block. In this position, forces Fs of the secondary cylinders 7 on the crown block thus comprise no vertical component (forces Fs cancel out). The resultant of the forces on the crown block therefore corresponds only to force Fp exerted by the main cylinder.

FIG. 2*c* illustrates an intermediate position of the first block where the crown block is in a higher position in relation to FIG. 2*b*. In this position, main cylinder 6 is only slightly compressed and it exerts a weak force Fp on the first block. Furthermore, in this position, the upper connecting rod is inclined upwardly, therefore forces Fs exerted by secondary cylinders 7 on the crown block are directed upwards. The vertical component of forces Fs of the secondary cylinders thus adds up to force Fp of the main cylinder.

FIG. 2*d* illustrates the highest position of the first block. In this position, main cylinder 6 is only slightly compressed and it exerts a minimum force Fp on the first block. Furthermore, in this position, the upper connecting rod is sharply inclined upwardly, therefore forces Fs exerted by secondary cylinders 7 on the crown block are directed upwards. The vertical component of forces Fs of the secondary cylinders thus adds up to force Fp of the main cylinder.

Figure 3A:
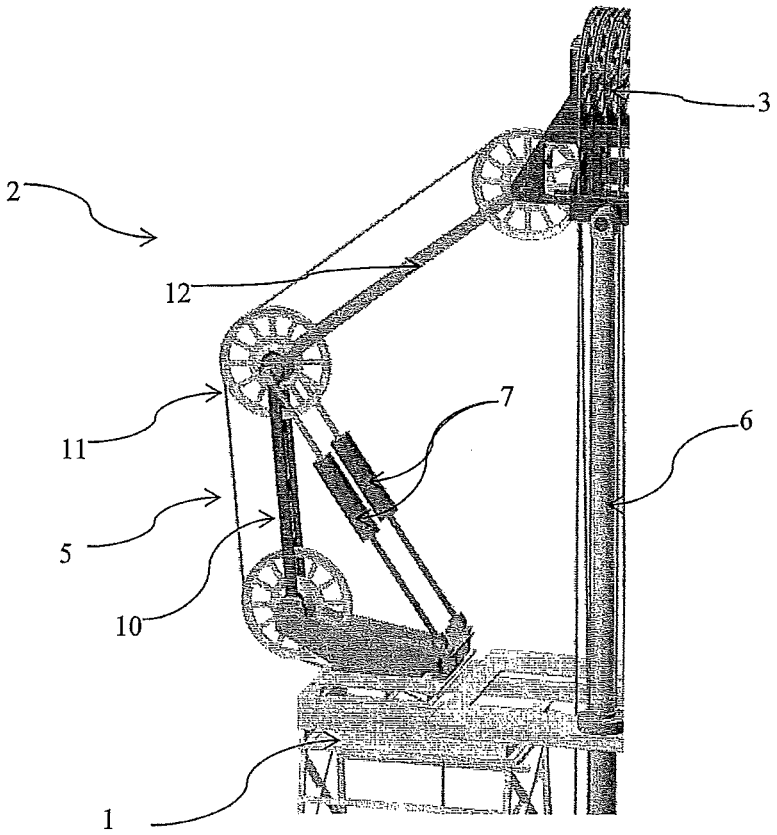
FIGS. 3*a* and 3*b* respectively illustrate embodiments of a motion compensation system according to a variant embodiment of the invention which differ in having either a single, or two main cylinders.
Figure 3B:
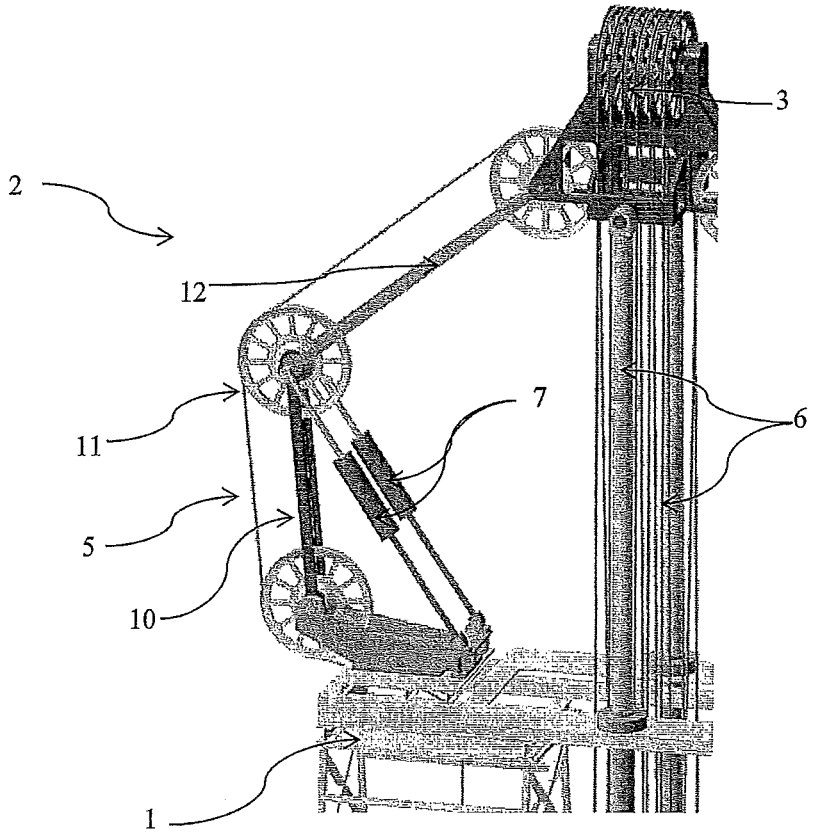

FIGS. 3*a* and 3*b* schematically respectively illustrate by way of non-limitative example respective compensators which in FIG. 3*a* have a single main cylinder 6 and in FIG. 3*b* have two main cylinders 6. Each embodiment operates with the same overall mode of motion compensation according to a variant embodiment of the invention. The FIGS. 3*a* and 3*b* are partial views illustrating a single articulated arm 2. A load (not shown) hangs from a travelling block (not shown), connected by a cable 5 to a crown block 3. Crown block 3 is mounted on a frame that is connected to mobile unit 1 by two articulated arms 2. Each articulated arm comprises a lower connecting rod 10 articulated (i.e. rotating about a horizontal axis) relative to mobile unit 1 and an upper rod 12 articulated (i.e. rotating about a horizontal axis) on the one hand relative to crown block 3 and, on the other hand, relative to lower rod 10. The joint between upper rod 12 and lower rod 10 further comprises a pulley 11. Pulleys are also provided at the ends of rods 10 and 12. Cable 5 runs through all the pulleys of the articulated arms and through the two blocks. The compensation system comprises a single main cylinder 6 in FIG. 3*a* and a pair of main cylinders in FIG. 3*b* and two secondary cylinders 7. Each main cylinder 6 is a hydraulic cylinder whose one end is attached to mobile unit 1 and whose other end is attached to the frame on which crown block 3 is mounted. The main cylinders 6 are powered by an oleopneumatic accumulator (not shown). For each articulated arm, the compensation system further comprises two secondary cylinders arranged between mobile unit 1 and the joint of articulated arm 2, at pulley 11. Secondary cylinders 7 are positioned on either side of pulley 11 so as to balance the forces. The two secondary cylinders 7 are pneumatic cylinders powered by a pneumatic accumulator (not shown).

The compensation system according to the invention can be used notably for compensating the heave motion of an offshore unit (ship, platform, . . . ) during offshore drilling operations, when setting a riser pipe, for a blowout preventer setting tool or downhole workover for resumption of drilling. In this case, the mobile unit is a floating unit, notably a ship, and the hanging element is a drill bit or a riser pipe or an offshore pipe laying tool.

Example

A heave compensation system according to the invention is tested in order to show the interest of the compensation system.

The example used is a compensation system comprising two hydropneumatic main cylinders connected to an oleopneumatic accumulator, two articulated arms 2 and four pneumatic secondary cylinders (two per articulated arm) connected to a pneumatic accumulator.

Figure 4:
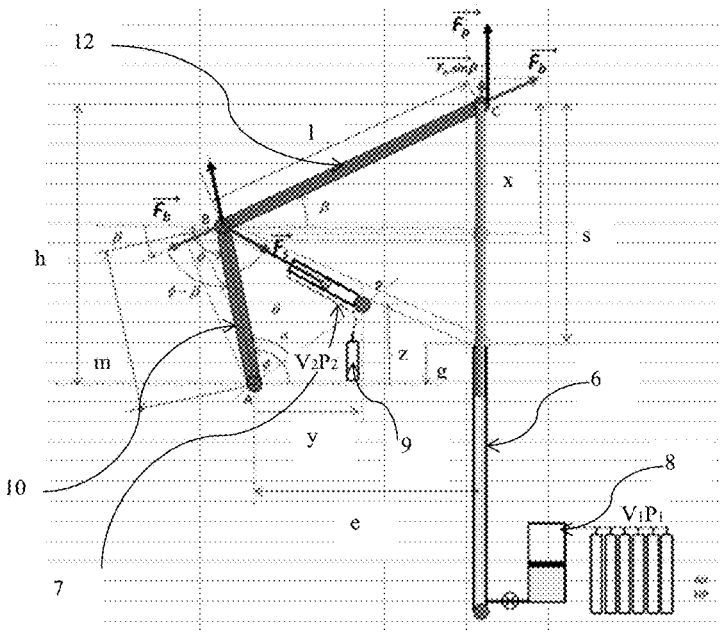
FIG. 4 illustrates a configuration of a compensation system according to the invention.

FIG. 4 illustrates a configuration of such a compensation system (only part of the compensation system is illustrated). The compensation system comprises a hydropneumatic cylinder 6 powered by a hydropneumatic accumulator 8 of volume V1 and pressure P1. The compensation system comprises an articulated arm 2 with a lower connecting rod 10 and an upper connecting rod 12. The compensation system further comprises a pneumatic secondary cylinder 7 powered by a pneumatic accumulator 9 of volume V2 and pressure P2. FIG. 4 illustrates the various dimensions of this system notably denoted by s, e, x, y, g, l, m.

Table 1 shows the dimensions of the compensation system, where dimensions s, e, x and y can be dimensioned so as to have a substantially constant cable length, independently of the dimensions of the main and secondary cylinders.

TABLE 1

Compensation system dimensions

| Parameters | Values |
|---|---|
| Load | 454 t |
| Crown block stroke s | 7.6 m |
| P1 | 209 bars |
| P2 | 166 bars |
| V1 | 6 $m^3$ |
| V2 | 0.4 $m^3$ |
| L | 6.5 m |
| M | 4.85 m |

Figure 5:
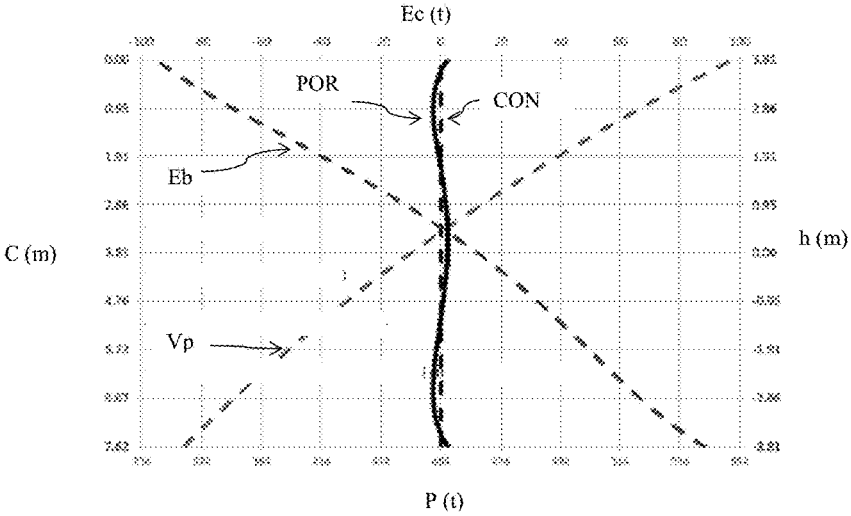
FIG. 5 is a graph showing forces as a function of lift for the compensation system according to the invention.

FIG. 5 is a graph illustrating several curves:

the setpoint value CON in tons for a 454-ton load, the force of the main cylinders alone Vp as a function of the lift P in t, of the stroke of the main cylinders C in m and of the height of the mobile unit h in m, the vertical force of the secondary cylinders Eb as a function of the lift P in t, of the stroke of the main cylinders C in m and of the height of the mobile unit h in m, and the resultant vertical lift POR which is the sum of the force of the main cylinders alone and of the vertical force of the secondary cylinders.

The maximum absolute deviation of the resultant lift POR from the hanging weight setpoint CON is below 4.54 ton, that is 1% of the load. The device is thus efficient by comparison with the prior art where the best results are rather of the order of 2% or more.

The main interest of the device lies in the reduction of the total volume of air required at high pressure. The best prior embodiments, as described in patent application French patent 2,575,452, require 15 to 20 $m^3$ air at high pressure (210 bar), whereas in the present example 6 $m^3$ main volume (V1) and 400 liters for the auxiliary circuit (V2) are sufficient with pressures of the same order.

The invention claimed is:

1. A motion compensation system for a load hanging from a mobile unit, comprising a crown block, a travelling block for fastening the load, at least one articulated arm for connecting the crown block to the mobile unit, each articulated arm comprising at least one pulley, a cable running through the at least one pulley, each articulated arm and through the blocks, at least a first main cylinder fastened to the mobile unit and to the crown block and at least one secondary cylinder rotationally mounted on the mobile unit and rotatably mounted on a joint of the at least one articulated arm about which the at least one articulated arm rotates during motion.

2. A system as claimed in claim 1, wherein the main cylinder is a hydropneumatic cylinder connected to an oleopneumatic accumulator.

3. A system as claimed in claim 2, wherein the secondary cylinder is a pneumatic cylinder connected to a pneumatic accumulator.

4. A system as claimed claim 3, wherein the articulated arm comprises at least two connecting rods articulated relative to one another and a pulley located at the joint on which the secondary cylinder is rotationally mounted.

5. A system as claimed in claim 4, wherein ends of the rods each comprise a pulley passing the cable.

6. A system as claimed claim 2, wherein the articulated arm comprises at least two connecting rods articulated relative to one another and a pulley located at the joint on which the secondary cylinder is rotationally mounted.

7. A system as claimed in claim 6, wherein ends of the rods each comprise a pulley passing the cable.

8. A system as claimed in claim 2, comprising at least two articulated arms arranged symmetrically relative to an axis formed by the first and second blocks.

9. A system as claimed in claim 2, comprising at least two secondary cylinders arranged symmetrically relative to an axis of the first main cylinder so that components of actions of the at least two secondary cylinders orthogonal to a direction of displacement of the crown block cancel each other out for any position of the crown block.

10. A system as claimed in claim 1, wherein the secondary cylinder is a pneumatic cylinder connected to a pneumatic accumulator.

11. A system as claimed claim 10, wherein the articulated arm comprises at least two connecting rods articulated relative to one another and a pulley located at the joint on which the secondary cylinder is rotationally mounted.

12. A system as claimed in claim 11, wherein ends of the rods each comprise a pulley passing the cable.

13. A system as claimed in claim 10, comprising at least two articulated arms arranged symmetrically relative to an axis formed by the first and second blocks.

14. A system as claimed in claim 10, comprising at least two secondary cylinders arranged symmetrically relative to an axis of the first main cylinder so that components of actions of the at least two secondary cylinders orthogonal to a direction of displacement of the crown block cancel each other out for any position of the crown block.

15. A system as claimed claim 1, wherein the articulated arm comprises at least two connecting rods articulated relative to one another and a pulley located at the joint on which the secondary cylinder is rotationally mounted.

16. A system as claimed in claim 15, wherein ends of the rods each comprise a pulley passing the cable.

17. A system as claimed in claim 16, comprising at least two articulated arms arranged symmetrically relative to an axis formed by the first and second blocks.

18. A system as claimed in claim 16, comprising at least two secondary cylinders arranged symmetrically relative to an axis of the first main cylinder so that components of actions of the at least two secondary cylinders orthogonal to a direction of displacement of the crown block cancel each other out for any position of the crown block.

19. A system as claimed in claim 15, comprising at least two articulated arms arranged symmetrically relative to an axis formed by the first and second blocks.

20. A system as claimed in claim 15, comprising at least two secondary cylinders arranged symmetrically relative to an axis of the first main cylinder so that components of actions of the at least two secondary cylinders orthogonal to a direction of displacement of the crown block cancel each other out for any position of the crown block.

21. A system as claimed in claim 1, comprising at least two articulated arms arranged symmetrically relative to an axis formed by the first and second blocks.

22. A system as claimed in claim 21, comprising s at least two secondary cylinders arranged symmetrically relative to an axis of the first main cylinder so that components of actions of the at least two secondary cylinders orthogonal to a direction of displacement of the crown block cancel each other out for any position of the crown block.

23. A system as claimed in claim 1, comprising at least two secondary cylinders arranged symmetrically relative to an axis of the first main cylinder so that components of actions of the at least two secondary cylinders orthogonal to a direction of displacement of the crown block cancel each other out for any position of the crown block.

24. A system as claimed in claim 1, comprising the first main cylinders and a second main cylinder.

25. A system as claimed in claim 1, comprising two secondary cylinders for each articulated arm.

26. A method of use of a system as claimed in claim 1, comprising providing heave compensation during hanging of the load hanging from the mobile unit.

* * * * *